US005274961A

United States Patent [19]

Himmelsbach et al.

[11] Patent Number: 5,274,961

[45] Date of Patent: Jan. 4, 1994

[54] APPARATUS FOR GRINDING CAMS

[75] Inventors: Georg Himmelsbach, Haslach; Erwin Junker, Junkerstrasse 2, D 7618 Nordrach, both of Fed. Rep. of Germany

[73] Assignee: Erwin Junker, Nordrach, Fed. Rep. of Germany

[21] Appl. No.: 997,273

[22] Filed: Dec. 23, 1992

Related U.S. Application Data

[62] Division of Ser. No. 824,437, Jan. 23, 1992.

[30] Foreign Application Priority Data

Feb. 1, 1991 [DE] Fed. Rep. of Germany ..... 4103090

[51] Int. Cl.[5] ..... B24D 5/06

[52] U.S. Cl. ..... 51/206 P; 51/206 R; 51/105 EC

[58] Field of Search ..... 51/281

[56] References Cited

U.S. PATENT DOCUMENTS 4,548,000 10/1985 Junker ..... 51/206 P 4,829,715 5/1989 Langlois ..... 51/165.75

5,024,026 6/1991 Korb ..... 51/206 P

FOREIGN PATENT DOCUMENTS 3724698 2/1989 Fed. Rep. of Germany .

261227 11/1926 United Kingdom ..... 51/206 P

*Primary Examiner*—Bruce M. Kisliuk

*Assistant Examiner*—Bo Bounkong

*Attorney, Agent, or Firm*—Jordan and Hamburg

[57] ABSTRACT

A rough grinding wheel has a plurality of annular grooves with widths at the surfaces of the grooves that are less than the widths thereof at the bottoms of the grooves. This feature provides a space for fluid during the grinding process. A finishing wheel may be mounted on a common shaft with the rough grinding wheel. The rough grinding wheel is intended for use in a method for grinding the outer contour of a cam wherein the cam is rough-ground with the roughing wheel; after a first radial infeed, the rough grinding wheel is withdrawn and axially displaced for a second infeed; this process is repeated until the cam is rough-ground.

9 Claims, 2 Drawing Sheets

APPARATUS FOR GRINDING CAMS

This is a division of application Ser. No. 07/824,437, filed Jan. 23, 1992 still pending.

FIELD OF THE INVENTION

The invention relates to a method and means of grinding cams and the like.

BACKGROUND OF THE INVENTION

In a known method and apparatus of this kind (DE 37 24 698 A1) a roughing grinding wheel has the form of an interchangeable grinding wheel which can be removed from the grinding spindle. This interchangeable grinding wheel has sections to break the edges of the cams during roughing. During the grinding procedure the roughing wheel is not displaced laterally, instead the cam contour is roughed by a single plunge cut prior to the interchangeable grinding wheel being removed. A different roughing wheel is required for each cam width or for each chamfer form. During roughing the contact surface between the grinding wheel and the workpiece is large, to which no coolant is able to find access. This results in the feed rate having to be kept relatively low since excessively increasing the feed rate or cutting volume per unit of time would heat up the workpiece too rapidly. This in turn produces grinding cracks in the surface or even a change in the structure of the workpiece which is, of course, not wanted. This known method of grinding can be employed only to a limited extent also with new materials finding increasing application, especially e.g. hard shell castings or materials exhibiting quite different properties when being machined that those normally used formerly.

U.S. Pat. No. 3,019,562 and JP Abstract 54-83195 also describe working with two grinding disks, the roughing being done with a roughing wheel having a cylindrical grinding surface and the outer surface of the cam then being finished by means of a separate finishing wheel once roughing has been completed after one or more rotations of the workpiece. Here too, the disadvantages involved excessive heating occurs as already mentioned in conjunction with DE 37 24 698 A1.

SUMMARY OF THE INVENTION

The object of the invention is thus to avoid these disadvantages and to teach a method and apparatus for of grinding in which, in particular, specific cooling of the grinding zone is possible during roughing.

By configuring the roughing wheel with at least one radial circumferential groove on the outer circumference it is achieved that the complete peripheral surface of the cam is not machined in one pass. This introduces a reduction in the amount of heating which in turn contributes towards enabling a coolant to be introduced at the lands remaining in the grooves during grinding. Accordingly, high cutting rates and an increased cutting volume per unit of time are possible, i.e. feed rate and bite can be increased so that, even in high-speed maching, changes in the structure or grinding cracks in the workpiece are eliminated.

This enables faster and, accordingly, more cost-effective grinding. Furthermore, the roughing and finishing wheels can be selected with differing grit sizes, properties and compositions to positively affect the grinding parameters.

BRIEF DESCRIPTION OF THE DRAWINGS

The invention will now be described in more detail on the basis of the embodiments shown in the drawings in which.

DESCRIPTION OF THE PREFERRED EMBODIMENTS

Figure 4:
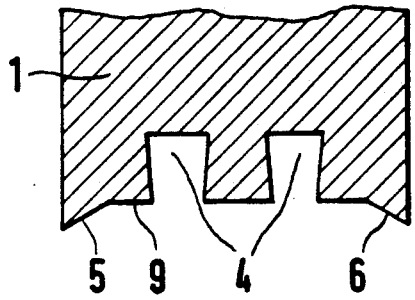
FIG. 4 shows a cross-section through the grinding surface of the roughing wheel.
Figure 2:
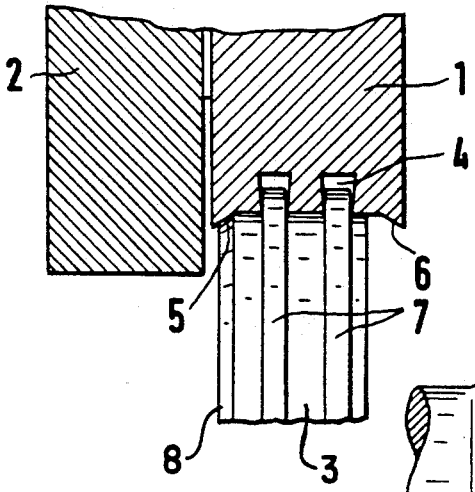
FIG. 2 shows the roughing wheel in plunge-cut grinding.

FIG. 2 shows how a cam 3 is rough-ground by plunge-cutting. "Plunge-cutting" of cams is understood by those skilled in the art to mean cutting only by relative radial movements. The roughing wheel 1 is wider than the cam 3 and features two radial annular grooves 4 on its outer circumference. These grooves 4 become wider inwards so that between the flanks of the grooves 4 and the lands 7 remaining during grinding clearance angles result in which a coolant can be introduced. The actual grinding surface does not cover the full width of the cam. This is particularly obvious in FIG. 4 which shows that an electroplated grinding coating 9 is interrupted by the grooves 4. This grinding wheel can also be produced with a metal-cemented CBN grinding coating.

Figure 7:
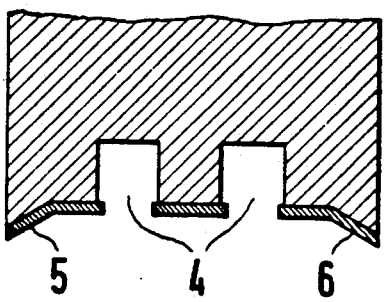
FIG. 7 shows a modified embodiment of the radial grooves on the circumference of the grinding wheel

Another embodiment of the roughing wheel is shown in FIG. 7. Here, the grinding coating is produced to slightly protrude over the side surface of the grooves 4 so that the grooves 4 running radially around the outer circumference can be machined to have a constant width down to the bottom of the groove. This embodiment achieves the same advantages as the embodiment according to FIG. 4.

When grinding in accordance with FIG. 2 the chamfer 8 of the cam 3 shown on the left of the FIG. is simultaneously ground. For this purpose the roughing wheel 1 has protruding edges 5 and 6 which can be freely selected in cross-section to be roughly triangular according to FIG. 2 or FIG. 3, their inclination corresponding to the desired profile of the chamfers 8.

Figure 3:
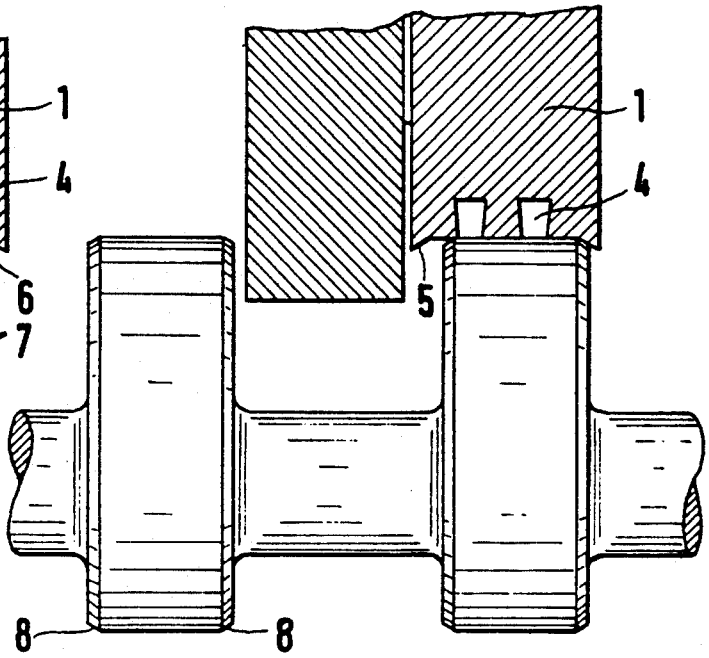
FIG. 3 shows finish rough-grinding of a cam following axial displacement of the roughing wheel.

As can be seen from FIG. 2 the edge 6 on the right and a neighbouring region of the grinding surface are not in contact with the cam 3 due to greater width of the roughing wheel 1 with respect to cam 3. Once roughing has progressed sufficiently so that the lands 7 penetrate into the grooves a certain distance, the roughing wheel 1 is then axially displaced. The lands 7 - now positionally displaced with respect to the grooves 4-are then ground off while, at the same time, the chamfer 8 on the right is ground by the edge 6. The condition attained after this procedure following radial infeed of the grinding wheel is shown in FIG. 3.

Rough-grinding may be finished after once-only axial displacement of the roughing wheel 1, but, if necessary, further grinding cycles may follow. In any case, displacement of the roughing wheel is repeated as often as required until the finished roughing dimension is attained, whereby each grinding procedure is made for a single full rotation of the workpiece or several rotations thereof.

Figure 1:
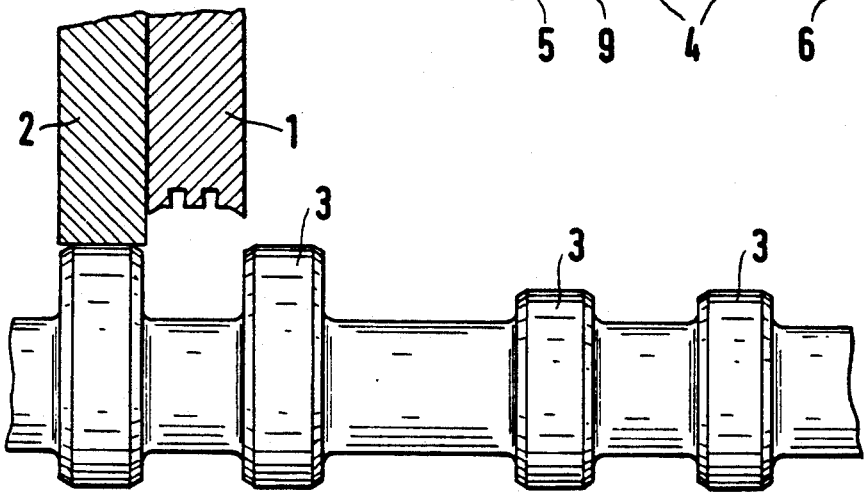
FIG. 1 shows the apparatus according to the invention for finish-grinding a cam.

Once the finished roughing dimension is attained the cam 3 is finish-ground by the finishing wheel 2. This is shown in FIG. 1. The outer circumference of the finishing wheel 2 features for this purpose the finished profile form of the cam 3. In FIG. 3 the finishing wheel 2 has a cylindrical outer circumference, it being, however, quite possible that the finishing wheel 2 can also be utilized to grind slanting or barrel-shaped cams; it then merely requiring a corresponding profile shape.

The finishing wheel may have a different grit and cement than that of the roughing wheel to achieve the desired surface and to effectively influence the grinding parameters. By finishing the two chamfers 8 during rough-grinding with the roughing wheel, the finishing wheel may have a very simple profile shape. In addition, no transverse forces occur at all at the finishing wheel and/or the workpiece during finishing which could negatively influence the machining accuracy, i.e. the grinding wheel and/or the camshaft are subject exclusively to radial loading.

Figure 5:
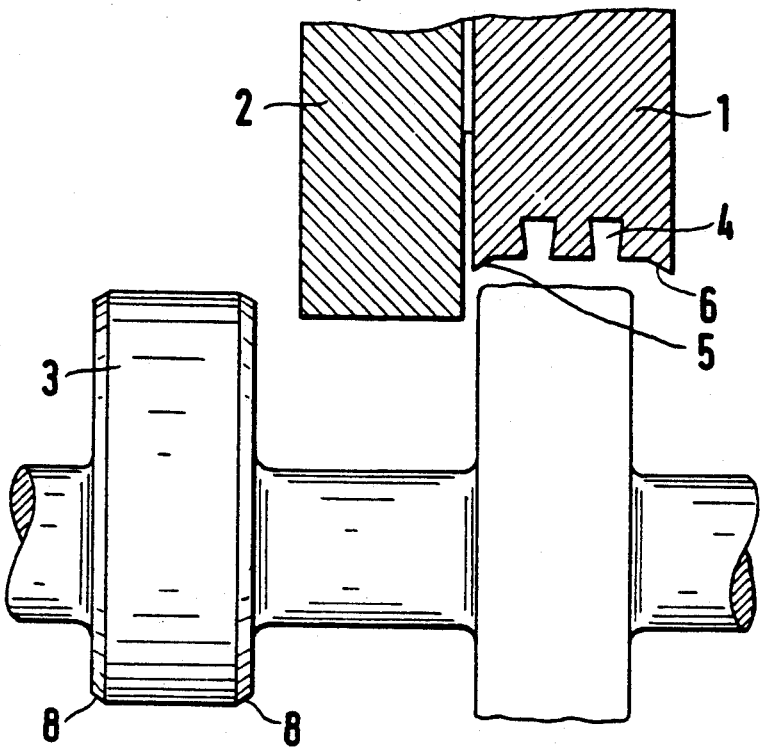
FIG. 5 shows the apparatus prior to commencing roughing, after a neighbouring cam has already been finished.

FIG. 5 shows cam 3 finish-ground while the neighbouring cam still has the rough cast shell surface. Here, the roughing wheel 1 is positioned immediately prior to first application, the result of which corresponds to the situation as shown in FIG. 2.

In FIGS. 1 thru 3 and in FIG. 5 both grinding wheels 1 and 2 are mounted on a common spindle, this arrangement permitting rough and finish grinding of the cam 3 in a single clamping operation.

Figure 6:
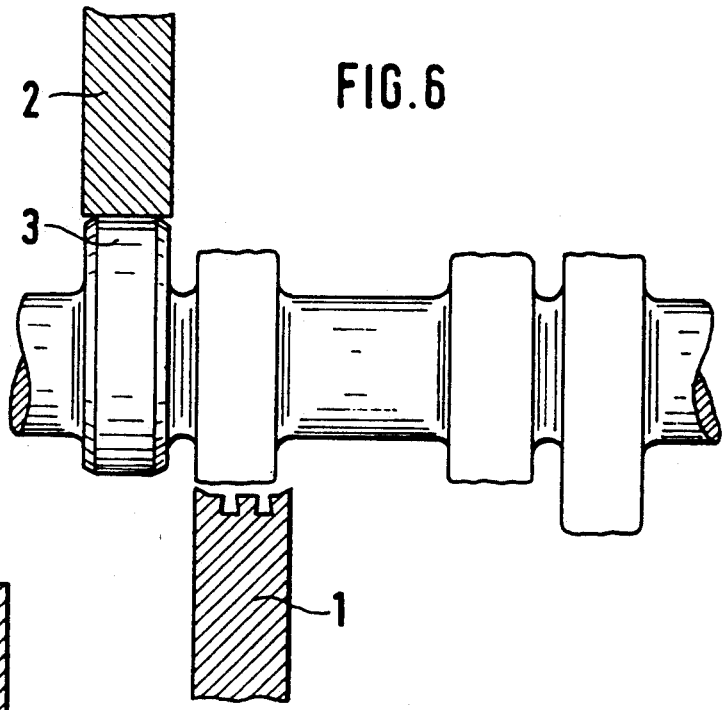
FIG. 6 shows a modified embodiment having grinding wheels mounted facing each other.

If the cams are mounted very close to each other it is not possible to machine them with the grinding wheels 1 and 2 mounted on a common spindle. In this case the grinding wheels 1 and 2 are arranged facing each other on the camshaft; viz. FIG. 6 where two grinding spindles are provided.

What is claimed is:

1. A roughing wheel for grinding a workpiece, comprising a grinding wheel having at least one radial circumferential groove on its outer circumference, a radially inner extremity of the groove being at least as wide as a radially outer extremity of the groove, grinding surfaces consisting of a coating of grinding material formed on the outer circumference of the grinding wheel and protruding past edges of said groove, the groove being free of said coating of grinding material, said roughing wheel having a width greater than an axial dimension of said workpiece.

2. The roughing wheel of claim 1 wherein the coating of grinding material is electroplated onto the outer circumference of the grinding wheel.

3. The roughing wheel of claim 2 wherein said groove has a rectangular cross-section.

4. The roughing wheel of claim 2 wherein said wheel has a plurality of said grooves and said grooves are symmetrical in the cross-section of said roughing wheel.

5. The roughing wheel of claim 1 wherein said radial circumferential groove is symmetrical in the cross-section of said roughing wheel.

6. The roughing wheel of claim 1 wherein said groove has a dovetail shaped cross-section.

7. The roughing wheel of claim 1 wherein the grinding surfaces of said roughing wheel are metal-cemented CBN.

8. The roughing wheel of claim 7 wherein said wheel has a plurality of said grooves, and said grooves have rectangular cross-sections.

9. The roughing wheel of claim 1 wherein said wheel has a plurality of said grooves and said grooves have dovetail shaped cross-sections.

* * * * *